US005152908A

United States Patent [19]

Tipton

[11] Patent Number: 5,152,908

[45] Date of Patent: Oct. 6, 1992

[54] GEAR LUBRICANT PACKAGE CONTAINING A SYNERGISTIC COMBINATION OF COMPONENTS

[76] Inventor: Craig D. Tipton, 3595 Call Rd., Perry, Ohio 44081

[21] Appl. No.: 752,174

[22] Filed: Aug. 23, 1991

Related U.S. Application Data

[63] Continuation of Ser. No. 569,509, Aug. 17, 1990, abandoned, which is a continuation of Ser. No. 47,754, May 7, 1987, abandoned.

[51] Int. Cl.[5] ..... C10M 141/12

[52] U.S. Cl. ..... 252/32.7 E; 252/39; 252/41; 252/50; 252/45; 252/18

[58] Field of Search ..... 252/39, 41, 50, 45, 252/32.7 E, 18

[56] References Cited

U.S. PATENT DOCUMENTS

| | | | |
|---|---|---|---|
| 3,396,109 | 8/1968 | Butler | 252/32.7 E |
| 3,480,548 | 11/1969 | Hellmuth et al. | 252/33.4 |
| 3,664,954 | 5/1972 | Chiola et al. | 252/32.7 E |
| 3,813,336 | 5/1974 | Goldschmidt | 252/32.7 E |
| 3,903,003 | 9/1975 | Murphy et al. | 252/51.5 A |
| 3,923,669 | 12/1974 | Newingham et al. | 252/32.7 |
| 3,929,650 | 12/1975 | King et al. | 252/33.4 |
| 4,101,427 | 7/1978 | Shaub | 252/32.7 E |
| 4,481,122 | 11/1984 | Root et al. | 252/32.7 E |
| 4,534,873 | 8/1985 | Clark | 252/32.7 E |
| 4,539,126 | 9/1985 | Bleeker et al. | 252/39 |
| 4,563,302 | 1/1986 | Griffin et al. | 252/45 |
| 4,634,541 | 1/1987 | Caspari et al. | 252/32.7 E |
| 4,792,410 | 12/1988 | Schwind et al. | 252/38 |

OTHER PUBLICATIONS

Smallheer, Lubricant Additives, pp. 7–9.

*Primary Examiner*—Prince Willis, Jr.
*Assistant Examiner*—Jerry D. Johnson
*Attorney, Agent, or Firm*—James L. Cordek; Frederick D. Hunter, Sr.; Joseph P. Fischer

[57] ABSTRACT

A number of functional characteristics of a gear lubricant are improved by including within the lubricant an additive package comprised of (a) a treated zinc dithiophosphate and (b) an overbased carboxylate which is preferably borated. The additive preferably includes (c) an alkylamine, (d) a sulfurized olefin and (e) a polymeric foam inhibitor. The components of the package provide an interdependent synergistic improvement of numerous performance characteristics of the gear lubricant such as reducing copper strip corrosion, increasing thermal stability and reducing the amount of rust, and odor. The limited slip or anti-chatter performance of the oil is also improved.

11 Claims, No Drawings

GEAR LUBRICANT PACKAGE CONTAINING A SYNERGISTIC COMBINATION OF COMPONENTS

This is a continuation of application Ser. No. 07/569,509 filed Aug. 17, 1990 now abandoned, which is a continuation of copending application Ser. No. 07/047,754 filed on May 7, 1987 now abandoned.

FIELD OF THE INVENTION

The present invention relates to the field of lubricants containing additive packages which improve the performance of the lubricants. More specifically, the invention relates to additive packages and gear lubricants having therein a combination of components which provide an interdependent synergistic effect on improving numerous characteristics of the gear lubricant. The additive package is comprised of (a) a treated zinc dithiophosphate which is preferably treated with propylene oxide and (b) an overbased carboxylate which is preferably borated. The additive preferably also includes an alkylamine, a sulfurized olefin and a polymeric foam inhibitor.

BACKGROUND OF THE INVENTION

Gear lubricant packages are included in gear lubricants in order to improve performance characteristics of the lubricant. A number of different additive compounds are known to effect the performance characteristics of a variety of different types of lubricants. However, a given additive compound can have different effects on performance characteristics depending on the type of lubricant it is added to and the other additive compounds present in the lubricant. Therefore, a formulator must consider not only the principle effects of including a given compound but how the effects of the compound are changed due to the presence of other compounds and the total environment the final product will be used in.

U.S. Pat. No. 3,923,669 discloses antiwear hydraulic oils which include therein zinc dialkyl dithiophosphate antiwear agents. In addition, the additive package includes neutral barium salts of a petroleum sulfonate and a succinic acid based rust inhibitor.

U.S. Pat. No. 3,480,548 discloses lubricating compositions comprised of a major amount of lubricating oil and an additive package which includes an oil soluble normal alkaline earth metal hydrocarbon sulfonate and an alkaline earth metal polyborate alkaline earth metal carbonate in a colloidal-like dispersion.

U.S. Pat. No. 3,929,650 discloses a particulate dispersion of an alkali metal borate which is prepared by contacting boric acid with an alkaline earth metal carbonate overbased metal sulfonate within an oleophilic liquid reaction medium. The resulting particulate dispersion is included within a lubricant in order to improve the performance characteristics.

U.S. Pat. No. 3,903,003 discloses lubricating oil compositions which are intended for use in connection with internal combustion engines. The lubricating oils include additive packages which comprise an amido amine reaction product formed between certain carboxylated hydrogenated polyisoprenes and certain amines, imines and hydroxyl alkyl polyamines. The additive is indicated as being used in connection with a number of different types of lubricants including gear lubricants.

U.S. Pat. No. 4,563,302 discloses sulfurized olefins which are utilized in connection with lubricating oils in order to improve the stability of the oil. A specific process for manufacturing such sulfurized olefins is disclosed.

U.S. Pat. No. 4,481,122 discloses lubricating compositions which include major amounts of a base oil and a minor amount of an additive which comprises an oil soluble polymer such as polyisobutylene. Specific compounds such as an organo silicone anti foaming agent is also indicated as being included within the lubricating oil.

SUMMARY OF THE INVENTION

The additive package of the invention includes (a) a treated zinc dithiophosphate and (b) an overbased carboxylate which is preferably borated. The package is added to a gear lubricant containing (c) an alkylamine and (d) a sulfurized olefin or other additive components which input the characteristics of (c) and (d) when used in connection with (a) and (b). In addition there is disclosed a gear lubricant essentially comprised of a major amount of an oil of lubricating viscosity and a minor amount of an additive package which is comprised of four essential components. The four essential components include (a) a treated zinc dithiophosphate, (b) an alkylamine and (d) a sulfurized olefin. The additive package and the gear lubricant preferably include (e) a polymeric foam inhibitor. The components (a)–(d) provide an interdependent synergistic improvement of numerous performance characteristics of a gear lubricating oil.

An object of the invention is to provide a gear lubricant additive package and a gear lubricant oil containing such an additive package which can be economically produced and which possesses improved performance characteristics.

Another object of the invention is to provide a gear lubricant comprised of a major amount of oil of lubricating viscosity and a minor amount of an additive package comprised of treated zinc dithiophosphate, an overbased carboxylate, an alkylamine and a sulfurized olefin.

Another object of the invention is to provide a gear lubricant additive package comprised of (a) a treated zinc dithiophosphate and (b) an overbased carboxylate.

Yet another object is to provide such a package further comprised of (c) an alkylamine, (d) a sulfurized olefin and (e) polymeric foam inhibitor An advantage of the present invention is that the additive package can be produced economically and efficiently.

Another advantage of the present invention is that the additive package improves a number of functional characteristics of gear lubricants.

Another advantage of the present invention is that the components of the additive package provide an interdependent synergistic result with respect to improving performance characteristics of the gear lubricant.

A feature of the present invention is that the additive package greatly improves copper strip corrosion protection which is advantageous in connection with a gear lubricant oil used in contact with copper containing components.

Another feature of the present invention is that the additive package increases the thermal stability of the gear lubricant.

Still, another feature of the present invention is that the additive package improves anti-corrosion properties, and anti-chatter properties while reducing the odor relative to conventional gear lubricants.

Still, another feature of the invention is that performance in limited slip axles is significantly improved.

These and other objects, advantages and features of the present invention will become apparent to those persons skilled in the art upon reading the details of the composition and usage as more fully set forth below reference being made to the accompanying general formulations and structural formulas forming a part hereof wherein like symbols refer to like components and molecular moieties throughout.

DETAILED DESCRIPTION OF PREFERRED EMBODIMENTS

Before the present gear lubricant additive package and gear lubricant are described, it is to be understood that this invention is not limited to the particular components or amounts as described as such components and amounts may, of course, vary. It is to be understood that the terminology used herein is for the purpose for describing particular embodiments only, it is not intended to be limiting since the scope of the present invention will be limited only by the appended claims.

It must be noted that as used in this specification and the appended claims, the singular forms "a", "an" and "the" include plural referents unless the context clearly dictates otherwise. Thus, for example reference to "a treated zinc dithiophosphate" includes mixtures of such treated zinc dithiophosphates, reference to "an overbased carboxylate includes reference to mixtures of such carboxylates", and reference to "an alkylamine" includes mixtures of alkylamines which may vary in small increments over a range in order to provide a statistical mixture of such components. The inclusion of such statistical mixtures of components which vary in small increments over a range is conventional within the art of lubricant additives in that lubricant additives must be economically and efficiently produced from crude reactant components which themselves are statistical mixtures.

The additive package of the invention must include (a) a treated zinc dithiophosphate and (b) an overbased carboxylate. The package comprised of (a) and (b) is useful as an additive package for its ability to improve the corrosion resistance and anti-wear properties of a gear lubricant oil. The package with (a) and (b) is added to a gear oil containing (c) an alkylamine and (d) a sulfurized olefin or to a gear oil containing other additive components which act in place of (c) and (d).

The fully formulated gear lubricant of the present invention is necessarily comprised of four components. Those four components include (a) a treated zinc dithiophosphate; (b) an overbased carboxylate which is preferably borated; (c) an alkylamine, and (d) a sulfurized olefin. An optional component which is believed to further increase the performance characteristics of the gear lubricant is (e) a polymeric foam inhibitor.

By including the additive package within a gear lubricant, a number of functional characteristics of the gear lubricant are improved. More specifically, the components of the additive package provide an interdependent synergistic improvement of numerous performance characteristics such as preventing copper strip corrosion, increasing thermal stability, reducing the amount of rust and odor, and improving limited slip or anti-chatter performance. Each of the specific components of the additive package will now be described in detail in order to describe and disclose a representative number of examples of such components which might be used in connection with the present invention.

TREATED ZINC DITHIOPHOSPHATE

A number of different types of zinc dithiophosphate compounds are useful additives as anti-wear agents in various types of lubricants. Zinc dithiophosphates continue to provide one of the most economical sources of anti-wear protection. There are three general types of zinc dithiophosphates from which to select, depending on the specific application. The zincs are classified as either primary, secondary, or aryl, depending on the alcohols from which they are made, although the primary and secondary zincs are commonly referred to as alkyl. If the R-O group in the structure for zinc dithiophosphate (shown below) is derived from a primary alcohol, then the zinc is referred to as primary; likewise, if it is derived from a secondary alcohol, it is referred to as secondary and, if derived from a phenol or an alkylated phenol, it is referred to as aryl.

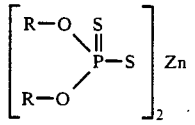

| R—O Derived From: | Zinc Dithiophoshate Classified as: |
|---|---|
| R—$CH_2$—OH e.g. $CH_3$—$(CH_2)_n$—$CH_2$—OH | Primary |
| R—CH(R)—OH e.g. $CH_3$—$(CH_2)_n$—CH(—$CH_2$)—OH, $CH_3$—$(CH_2)_m$—$CH_2$ | Secondary |
| 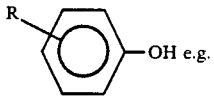 | Aryl |

Each of these zincs usually displays a different combination of performance properties as summarized below:

| Performance Characteristic | Type of Zinc Dithiophospate | | |
|---|---|---|---|
| | Primary | Secondary | Aryl |
| Wear Protection | Average | Best | Poorest |
| Oxidation Inhibition | Average | Best | Poorest |
| Thermal Stability | Average | Poorest | Best |
| Demulsibility | Best | Average | Poorest |
| Cost | Lowest | Average | Highest |

NOTE - Variations are present among different compounds in any given class. Further, different sources may rate any given performance characteristics differently.

Based on their relative performance levels, zincs are selected for a particular application. For example, aryl zincs are used almost exclusively in diesel engine oils because of their excellent thermal stability. Primary zincs find a large application in both engine oils and hydraulic oils. Secondary zincs are used mostly in hydraulic oils, transmission and gear oils. Primary and secondary zincs have been selected for these applications because of their relatively good anti-wear performance, good anti-oxidant qualities and low cost. Where hydraulic oils are concerned, primary zincs have usually been preferred because they offered the best overall performance for the lowest cost.

In the gear lubricant additive and oil of the present invention zinc dithiophosphate may be present. However, the present invention uses zinc dithiophosphate, preferably secondary zinc dithiophosphates as intermediates by reacting the zinc dithiophosphate with a treating agent selected from alkylene oxides containing 2 to 5 carbon atoms, ethylene diamine and combinations thereof. The invention may include untreated zinc dithiophosphate in combination with those treated with one or more of the above mentioned treating agents. Most preferably the invention includes a propylene oxide treated secondary zinc dithiophosphate.

The treated zinc dithiophosphate may be present in the gear oil in an amount in the range of from about 0.1% to 5% by weight based on the weight of the oil, more preferably about 2.0% to 4.0% by weight and most preferably about 3.0% by weight. The amount of this component, like the other components can be adjusted by those skilled in the art to obtain the best results in a given environment. This component is present in the fully formulated gear oil in an amount sufficient to act as an EP/antiwear agent in the system. The treatment with a compound like propylene oxide decreases the potential corrosivity of this component as used in a system.

OVERBASED CARBOXYLATES (BORATED)

The overbased carboxylate component (b) of the present invention can be in a borated or non-borated form. However, it is pointed out that the borated versions are generally preferred. The borated versions of the overbased carboxylate component (b) of the invention are most generally prepared by reacting a boron reactant (preferably boric acid) with an overbased carboxylate.

The term "overbased compound" is generally used to designate metal salts wherein the metal is present in stoichiometrically larger amounts than the organic acid radical. The commonly employed methods for preparing overbased compounds involves heating a mineral oil solution of an acid with a stoichiometric excess of a metal neutralizing agent such as the metal oxide, hydroxide, carbonate, bicarbonate, or sulfide at a temperature above 50° C. and filtering the resulting mass. The use of "promoter" in the neutralization step to aid the incorporation of a large excess of metal is generally found to be useful. A particularly effective method of preparing a basic salt comprises mixing an acid with an excess of a basic alkaline earth metal neutralizing agent and at least one alcohol promoter and carbonating the mixture by passing $CO_2$ into the mixture at an elevated temperature between 10° C. and 200° C.

In connection with the present invention the overbased compound is an overbased carboxylate prepared by reacting a stoichiometric excess of a metal neutralizing agent with a carboxylic acid to form a carboxylate which includes a stoichiometric excess of the metal. Accordingly, for use in the present invention the anion portion of the overbased component is an ionized carboxylic acid or carboxylate. The cationic portion of the overbased component is typically an ionized alkali metal or alkaline earth metal. The commonly used alkaline metals are lithium, potassium and sodium, with sodium being preferred. The alkaline earth metal components typically utilized are magnesium, calcium, and barium with calcium and magnesium being preferred.

A typical calcium carboxylate can be represented empirically by $Ca(RCOO)_2 .XCa (OH)_2 .YCaCO_3$ where R is a hydrocarbyl as defined below and X and Y combined are greater than 1 and vary depending on the degree of overbasing desired. Some typical carboxylic acids used in preparing a carboxylate include tall oil fatty acid, oleic acid, linoleic acid, linolenic, and palmitic acids. The use of overbased calcium carboxylate of these acids are preferred.

After the overbased carboxylate component is formed the component may be borated by reacting with a boron reactant which is preferably boric acid. The boric acid is charged into the reaction medium in the desired amount in order to form different types of borates. Different amounts of $H_3BO_3$ may be charged into the system to obtain the desired amount of boron incorporation depending on the desired end results.

The overbased carboxylate component (b) in its borated and non-borated versions may be present in the gear oil in an amount in the range of from about 0.1% to 3%, preferably from about 0.2% to about 1.5% and most preferably about 0.5% by weight based on the weight of the fully formulated gear oil.

ALKYLAMINES

The alkylamine component (c) of the present invention may be a mono, di or polyamine. Further, it may be a primary, second or tertiary amine. However, in connection with the present invention it is preferred if the amine is a diamine compound represented by the general formula (I)

$$RNH(CH_2)_3NH_2$$

wherein R is hydrocarbyl. However, R is preferably an alkyl moiety containing about 10 to about 20 carbon atoms.

In formula (I) and elsewhere in the disclosure hydrocarbyl means "hydrocarbon-based." As used herein, the term "hydrocarbon-based," "hydrocarbon-based substituent" and the like denotes a substituent having a carbon directly attached to the remainder of the molecule and having predominantly hydrocarbyl character within the context of this invention.

Examples of hydrocarbyl substituents which might be useful in connection with the present invention include the following:

(1) hydrocarbon substituents, that is, aliphatic (e.g., alkyl or alkenyl), alicyclic (e.g., cycloalkyl, cycloalkenyl) substituents, aromatic, aliphatic and alicyclic-substituted aromatic nuclei and the like as well as cyclic substituents wherein the ring is completed through another portion of the molecule (that is, for example, any two indicated substituents may together form an alicyclic radical);

(2) substituted hydrocarbon substituents, that is, those substituents containing nonhydrocarbon radicals which, in the context of this invention, do not alter the predominantly hydrocarbon substituent; those skilled in the art will be aware of such radicals (e.g., halo (especially chloro and fluoro), alkoxy, mercapto, alkylmercapto, nitro, nitroso, sulfoxy, etc.);

(3) hereto substituents, that is, substituents which will, while having predominantly hydrocarbyl character within the context of this invention, contain other than carbon present in a ring or chain otherwise composed of carbon atoms. Suitable heteroatoms will be apparent to those of ordinary skill in the art and include, for example, sulfur, oxygen, nitrogen and such substituents as, e.g., pyridyl, furanyl, thiophenyl, imidazolyl, etc., are exemplary of these hereto substituents.

In general, no more than about three radicals or heteroatoms and preferably no more than one, will be present for each ten carbon atoms in the hydrocarbon-based substituents. Typically, there will be no such radicals or heteroatoms in the hydrocarbon-based substituent and it will, therefore, by purely hydrocarbon.

The alkylamine component (c) may be present in the gear oil in an amount in the range of from about 0.05% to about 1.0% by weight, preferably 0.1% to 0.4% and most preferably about 0.2% by weight based on the weight of the the gear oil as a whole.

SULFURIZED OLEFINS

Sulfurized olefins are well-known additives in lubricating oil, cutting oil and the like. Kimball, U.S. Pat. No. 2,249,312 (incorporated herein by reference), describes such a product. Eby, U.S. Pat. No. 2,708,199 (incorporated herein by reference), describes a similar product in which a sulfur halide is reacted with an olefin using a lower alkanol promoter to obtain an intermediate which is reacted with an alkali or alkaline earth metal polysulfide. Myers, U.S. Pat. No. 3,471,40 (incorporated herein by reference), describes a product in which sulfur monochloride is reacted with olefin to obtain an intermediate which is reacted with sulfur and alkali metal sulfide at a critical ratio of 1.8–2.2 gram moles of metal sulfide per gram mole of sulfur. This material is then refluxed for 1–24 hours with aqueous alkali metal hydroxide. In U.S. Pat. No. 4,204,969 (incorporated herein by reference), an effective sulfurized olefin is made by reacting a sulfur monochloride with an olefin in the presence of a lower alkanol promoter to obtain an adduct which is reacted with sodium sulfide and sulfur in aqueous alkanol.

A sulfurized olefin having improved solubility especially is a-olefin oligomer lubricating oil is made by reacting a monoolefin with $S_2Cl_2$ or $SCl_2$ to obtain an adduct which is reacted with sodium sulfide, sulfur, alkyl mercaptan and optionally sodium hydrosulfide in an aqueous alcohol reaction medium. Such a process is disclosed in U.S. Pat. No. 4,563,302 which is also incorporated herein by reference.

A process for making a sulfurized olefin having improved solubility in lubricating oil comprises:

a) reacting a sulfide halide selected from $SCl_2$, $S_2$—$Cl_2$ and mixtures thereof with an aliphatic monoolefin containing 3-6 carbon atoms to produce an adduct;

b) reacting said adduct with sulfur, $Na_2S$, an alkyl mercaptan containing 1–12 carbon atoms and optionally NaSH in an aqueous alcohol medium at a temperature of 50° C. up to reflux to form said sulfurized olefin;

c) recovering said sulfurized olefin from the aqueous alcohol medium. (See U.S. Pat. No. 4,563,302).

A useful product can be obtained using either $SCl_2$ or $S_2Cl_2$.

Useful olefins are the monoethylenically unsaturated aliphatic hydrocarbons referred to as aliphatic monoolefin containing 3 to about 6 carbon atoms. These include 1-butene, 2-butene, isobutene, 1-pentene, 2-pentene, 2-methyl-1-butene, 3-methyl-1-butene, 2-methyl-2-butene, 1-hexene, 2-hexene, 3-hexene, 2-methyl-1-pentene, 2-methyl-2-pentene, 2-ethyl-2-butene and the like including mixtures thereof.

Preferably the olefins are branched-chain olefin such as isobutene, 2-methyl-1-butene, 2-methyl-2-butene, 2-methyl-2-pentene and the like. More preferably the ethylenic double bond adjoins a tertiary carbon atoms such as isobutylene, the most preferred olefin.

The sulfurized olefin component (d) may be present in the gear oil in an amount in the range of from about 0.5% to about 8.0% by weight, preferably 3.0% to 4.0% and most preferably about 3.0% by weight based on the weight of the gear oil as a whole.

POLYMERIC FOAM INHIBITORS

Acrylate copolymer foam inhibitors have been found to be useful. A specific foam inhibitor which is commercially available from Monsanto is referred to as defoamer PC-1244. A specific copolymer defoamer compound is the copolymer of 2-ethylhexylacrylate/ethylacrylate in a weight ratio of 2.5:1. The copolymer is generally present in an amount of 40% by weight of active chemical in a toluene diluent. The copolymer is made by adding a mixture of monomers together with an initiator in toluene solvent in the proper proportions to a "heel." The reactants are combined together in a polymerization vessel at about 110° C. The resulting product is a polymer having a molecular weight in the range of about 40,000 and 90,000 (Mw). Wherein the Mn is in the range of 16,000–25,000. The viscosity at 40° C. is approximately 15 cSt.

A number of different types of foam inhibitors may be found to be useful in connection with the present invention. In general, polymeric foam inhibitors may be added in an amount of from about 0.01 to 1.0%, preferably 0.03 to 0.1 and most preferably about 0.075% by weight based on the weight of the fully formulated gear oil. The following examples are provided so as to provide those of ordinary skill in the art with a complete disclosure and description how to make the additive packages and gear oils of the invention and are not intended to limit the scope of what the inventors regard as their invention. Efforts have been made to insure accuracy with respect to numbers used (e.g. amounts, weight ratios, etc.) but some experimental errors and deviation should be accounted for. Unless indicated otherwise, parts are parts by weight, temperature is in degrees C, and pressure is at or near atmospheric.

EXAMPLE 1

An additive concentrate is prepared by combining 3% propylene oxide treated zinc dithiophosphate, 3% sulfurized olefin, 0.2% oleylamine plus 0.5% borated overbased fatty calcium carboxylate and 0.075% commercial polymeric foam inhibitor containing 40% active chemical. The components are added to a diluent oil to provide a 7.0% by weight concentrate.

EXAMPLE 2

The procedure of Example 1 is followed except that the 0.5% borated overbased fatty calcium carboxylate is replaced with 1.0% weight overbased fatty calcium carboxylate (non-borated) to make a 7.5% by weight concentrate.

EXAMPLE 3

A fully formulated gear oil can be prepared by combining about 92% of a mineral oil or combination of mineral oils such as (75% 600N +25% by weight 150 bright stock) with 7.0% weight concentrate described in Example 1 above and 1.0% weight polymeric pour point depressant.

EXAMPLE 4

A fully formulated gear oil can be prepared by adding to a mineral oil of lubricating viscosity, such as bright stock, about 0.1% to 5% of propylene oxide treated zinc dithiophosphate, about 0.1% to about 3.0% of overbased carboxylate which is preferably borated, about 0.05% to about 1.0% of an alkylamine, about 0.5% to about 8.0% of a sulfurized olefin, and about 0.01% to about 1.0% of a polymeric foam inhibitor.

EXAMPLE 5

Prepare a fully formulated gear oil by adding to a bright stock mineral oil 3.0 parts by weight of a propylene oxide treated zinc dithiophosphate, 0.5 parts by weight of a borated overbased magnesium carboxylate, 0.2 parts by weight of an alkylamine, and 3 parts by weight of a sulfurized olefin. The resulting fully formulated gear oil should contain 6.7 parts by weight of additive components with the remaining 93.3 parts by weight being bright stock mineral oil.

EXAMPLE 6

Add about 0.075 parts by weight of a polymeric foam inhibitor to the fully formulated gear lubricant of Example 5.

EXAMPLE 7

Prepare a gear lubricant additive package by combining together about 0.05 to 5.0 parts by weight of a propylene oxide treated zinc dithiophosphate and about 0.1 to about 3.0 parts by weight of an overbased carboxylate which is preferably borated. The additive components may be added to a small amount of mineral oil to act as a diluent oil. The additive is useful as an additive for combining with oils which contain an alkylamine and a sulfurized olefin and/or other components which provide the interaction and properties of the combination of the alkylamine and sulfurized olefin.

The present invention may be sold by itself or in concentrates, in combination with any other known additive which includes, but is not limited to dispersants, detergents, antioxidants, antiwear agents, extreme pressure agents, emulsifiers, demulsifiers, friction modifiers, anti-rust agents, corrosion inhibitors, viscosity improvers, dyes, and solvents to improve handleability which may include alkyl and/or aryl hydrocarbons. These additives may be present in various amounts depending on the needs of the final product.

The concentrate might contain 0.01 to 90% by weight of the additive package. The additive package may be present in a final product, blend or concentrate in (in a minor amount i.e., up to 50% by weight) any amount effective to improve the performance of characteristics of a gear oil but it is preferably present in gear oils in the form of mineral oils of lubricating viscosity in an amount of from about 1% to about 10%, preferably about 2% to about 8%, most preferably about 6.775% by weight by based on the weight of the fully formulated gear oil; where the individual components are present in amounts as follows: (a) about 3.0% (b) about 0.5% (c) about 0.2% (d) about 3.0% and (e) about 0.075%. The amounts of the additive package and individual components in the gear oil will be varied by those skilled in the art to obtain optimal performance. For example, smaller amounts of additive (1–3%) are generally used with industrial gear oils.

The instant invention is shown and described herein in what is considered to be the most practical and preferred embodiments. It is recognized, however, that departures may be made therefrom which are within the scope of the invention, and that obvious modifications will occur to one skilled in the art upon reading this disclosure.

What is claimed is:

1. A gear lubricant additive, comprising:

a) a treated zinc dithiophosphate wherein the zinc dithiophosphate is treated with an alkylene oxide;

b) a borated calcium overbased carboxylate;

c) an alkyl amine;

d) a sulfurized olefin; and e) a polymeric foam inhibitor.

2. The gear lubricant additive of claim 1, wherein the zinc dithiophosphate is treated with propylene oxide.

3. The gear lubricant additive of claim 2, wherein the alkylamine is represented by general formula (I):

$$\overset{H}{\overset{|}{R}}N(CH_2)_3NH_2$$

wherein R is hydrocarbyl.

4. The gear lubricant additive of claim 3, wherein R is an alkyl moiety containing 10 to 20 carbon atoms.

5. A gear lubricant, comprising a major amount of an oil of lubricating viscosity and a minor amount of:

a) a treated zinc dithiophosphate wherein the zinc dithiophosphate is treated with an alkylene oxide;

b) a borated calcium overbased carboxylate;

c) an alkylamine;

d) a sulfurized olefin; and e) a polymeric foam inhibitor.

6. The gear lubricant as claimed in claim 5, where the alkylamine is represented by general formula (I):

$$\overset{H}{\overset{|}{R}}N(CH_2)_3NH_2$$

wherein R is hydrocarbyl.

7. The gear lubricant as claimed in claim 6, where R is an alkyl moiety containing 10 to 20 carbon atoms.

8. The gear lubricant as claimed in claim 5, wherein the zinc dithiophosphate is treated with a propylene oxide.

9. A gear lubricant, comprising at least 90% by weight of an oil of lubricating viscosity and about 0.1% to about 10% by weight of an additive package comprising:

a) a propylene oxide treated zinc dithiophosphate;

b) a borated overbased carboxylate;

c) an alkylamine of formula (I):

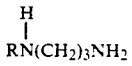

wherein R is an alkyl moiety containing 10 to 20 carbons;

d) a sulfurized olefin; and e) a polymeric foam inhibitor.

10. The gear lubricant as claimed in claim 9, wherein (b) is a calcium carboxylate and the additive package is present in an amount of about 4% to about 8% by weight.

11. The gear lubricant as claimed in claim 9, wherein (b) is a sodium carboxylate and the additive package is present in an amount of about 1–4% by weight.

* * * * *